US007500689B2

(12) United States Patent
Pasternak et al.

(10) Patent No.: US 7,500,689 B2
(45) Date of Patent: Mar. 10, 2009

(54) WHEELCHAIR ATTACHMENTS

(76) Inventors: Peter Pasternak, 2780 Autumn Dr., Crown Point, IN (US) 46307; Lisa Pasternak, 2780 Autumn Dr., Crown Point, IN (US) 46307

( * ) Notice: Subject to any disclaimer, the term of this patent is extended or adjusted under 35 U.S.C. 154(b) by 221 days.

(21) Appl. No.: 11/509,620

(22) Filed: Aug. 25, 2006

(65) Prior Publication Data

US 2007/0114755 A1 May 24, 2007

Related U.S. Application Data

(60) Provisional application No. 60/734,753, filed on Nov. 9, 2005.

(51) Int. Cl.
*A61G 5/10* (2006.01)

(52) U.S. Cl. ..... 280/304.1; 280/250.1; 280/650; 280/755; 297/153; 297/155; 297/183.6; 297/188.08

(58) Field of Classification Search ..... 297/153, 297/155, 183.6, 188.08; 280/304.1, 250.1, 280/650, 755

See application file for complete search history.

(56) References Cited

U.S. PATENT DOCUMENTS 1,449,436 A * 3/1923 Neill ..... 297/146
3,185,495 A 5/1965 Pivacek
3,338,627 A * 8/1967 Herman ..... 297/153
3,747,430 A * 7/1973 Miner ..... 74/523
3,860,285 A * 1/1975 Hartman ..... 297/150
3,863,521 A * 2/1975 Gatsos et al. ..... 74/551.4
3,881,773 A 5/1975 Rodaway
4,223,944 A * 9/1980 DeLong ..... 297/148
4,339,061 A 7/1982 Dunn (Continued)

FOREIGN PATENT DOCUMENTS

JP 6-154269 6/1994

(Continued)

OTHER PUBLICATIONS

Website, http://www.medicalproductsdirect.com/medicalproductsdirect/tilandrecwhel.html, Tilt and Recline Wheelchair by Invacare, two sheets printed Apr. 4, 2005.

(Continued)

*Primary Examiner*—Paul N Dickson
*Assistant Examiner*—Patrick Centolanzi
(74) *Attorney, Agent, or Firm*—Richard C. Litman

(57) ABSTRACT

The wheelchair attachments are configured for removable attachment to a wheelchair to facilitate use of the wheelchair by occupants and/or attendants. One attachment is a retractable tray spanning the armrests at the front of the chair when deployed and retracting between the chair structure and a wheel for storage. Another attachment is a series of interchangeably installable handgrips or handles removably installable to the front or back of the chair for use by an attendant. At least some of the various handgrips or handle assemblies provide horizontal and/or vertical adjustment. Yet another attachment is an underseat storage compartment, primarily accessible by an attendant from the back of the chair. All of the various attachments may be installed upon and/or used with a wheelchair independently of one another or in combination with one another, or may be adapted for use with other devices as well.

6 Claims, 7 Drawing Sheets

U.S. PATENT DOCUMENTS

| | | | | | |
|---|---|---|---|---|---|
| 4,759,562 | A | | 7/1988 | Vinyard et al. | |
| 4,779,884 | A | * | 10/1988 | Minati | 280/304.1 |
| 4,869,279 | A | * | 9/1989 | Hedges | 135/67 |
| 4,964,648 | A | * | 10/1990 | Berkowitz | 280/304.5 |
| 5,015,033 | A | * | 5/1991 | Winters | 297/188.12 |
| 5,026,114 | A | | 6/1991 | Miller | |
| 5,074,617 | A | | 12/1991 | Maxwell | |
| 5,106,156 | A | * | 4/1992 | Marquis | 297/153 |
| 5,141,242 | A | | 8/1992 | Henzel | |
| 5,154,331 | A | | 10/1992 | Sanders | |
| 5,228,711 | A | | 7/1993 | Summers | |
| 5,290,055 | A | * | 3/1994 | Treat, Jr. | 280/304.1 |
| 5,292,144 | A | | 3/1994 | Sosnoff | |
| 5,299,824 | A | * | 4/1994 | Roberts et al. | 280/304.1 |
| 5,454,581 | A | | 10/1995 | Ringer | |
| 5,470,093 | A | * | 11/1995 | Kiser | 280/304.1 |
| 5,567,080 | A | * | 10/1996 | Sterlacci | 403/322.1 |
| 5,605,345 | A | | 2/1997 | Erfurth et al. | |
| 5,816,648 | A | * | 10/1998 | Baccili et al. | 297/159.1 |
| 5,860,664 | A | | 1/1999 | Smith | |
| 5,915,712 | A | * | 6/1999 | Stephenson et al. | 280/304.1 |
| 6,101,680 | A | * | 8/2000 | Naf et al. | 19/102 |
| 6,340,168 | B1 | | 1/2002 | Woleen | |
| 6,685,264 | B2 | * | 2/2004 | Mullen et al. | 297/173 |
| 6,722,681 | B1 | * | 4/2004 | Large | 280/304.1 |
| 7,056,268 | B2 | * | 6/2006 | Emick | 482/106 |
| 7,216,929 | B2 | * | 5/2007 | Lang et al. | 297/155 |
| 2002/0067019 | A1 | | 6/2002 | Brown | |
| 2006/0061154 | A1 | * | 3/2006 | Kahan | 297/188.04 |

FOREIGN PATENT DOCUMENTS

| | | |
|---|---|---|
| JP | 6-169968 | 6/1994 |

OTHER PUBLICATIONS

Website, http://www.westons.com/acatalog/Online_ Catalogue_ Accessories_ 939.html, Armrest Pocket for wheelchairs, Ref. No. AO6474, one sheet printed Apr. 4, 2005.

Website, http://www.westons.com/acatalog/Online_Catalogue_Accessories_939.html, Flip Away Half Lap Tray for wheelchairs, Ref. No. A70712, one sheet printed Apr. 4, 2005.

Website, http://www.westons.com/acatalog/Online_Catalogue_Accessories_939.html, Softop Wheelchair Tray, Ref. No. AO6056, one sheet printed Apr. 4, 2005.

Website, http://www.westons.com/acatalog/Online_Catalogue_Accessories_939.html, Wheelchair Day Pack, Ref. No. AA8651, one sheet printed Apr. 4, 2005.

Website, http://www.westons.com/acatalog/info_AA8633.html, Under Wheelchair Bag, Ref. No. AA8633, one sheet printed Aug. 12, 2005.

* cited by examiner

WHEELCHAIR ATTACHMENTS

CROSS-REFERENCE TO RELATED APPLICATION

This application claims the benefit of U.S. Provisional Patent Application Ser. No. 60/734,753, filed Nov. 9, 2005.

BACKGROUND OF THE INVENTION

1. Field of the Invention

The present invention relates generally to wheelchairs and similar conveyances for the physically handicapped. More specifically, the present invention comprises a series of attachments that may be installed upon a conventional wheelchair with little or no modification to the chair. The attachments comprise a retractable tray, a series of removably installable handles at front and back, and an underseat storage compartment.

2. Description of the Related Art

The wheelchair has been known for a considerable time as a means for increasing the mobility and independence of the physically handicapped. However, the wheelchair is not without its problems and limitations, primarily due to the size and bulk of the typical wheelchair, and the seating configuration provided to the person using the chair.

One of the major problems with the conventional wheelchair is the relative bulk and volume required at the front of the chair. The conventional footrests extend forwardly from the chair for some span, and the widths and heights of the armrests and wheels require somewhat more room than would a seated person not requiring the wheelchair. This greatly limits the ability of a person in a wheelchair to position himself or herself reasonably close to a table, desk, or similar surface for dining, writing, or other activities requiring such a surface, as the height of the table or desk surface, as well as the structure supporting the surface, often preclude maneuvering the forward portion of the wheelchair beneath the surface to allow the person in the wheelchair to position himself or herself very close to the surface.

Another problem with conventional wheelchairs is the lack of storage space provided, particularly for an attendant accompanying the person in the wheelchair. While some storage has been developed for use by persons confined to wheelchairs, it is generally somewhat limited due to the proximity of the relatively large wheels on each side of the chair and other structure. In any event, practically nothing has been done to provide storage space for an attendant accompanying a person confined to a wheelchair. Typically, such an attendant must resort to asking the person in the wheelchair to carry any articles in his or her lap.

Yet another problem with wheelchairs is the lack of versatility and provision for handling the chair by an attendant. Conventionally, wheelchairs are provided with only a pair of rearwardly turned grips, which extend from the uprights supporting the backrest of the chair. Typically, these handgrips lack any means for adjustment or repositioning, thus limiting the manipulation of the chair by an attendant. Very little has been done in the past relating to any forwardly positioned handgrips or the like for an attendant to manipulate the chair from the front while facing a person seated in the chair, or to provide for any interchangeability for different handgrip configurations to the front or rear of the chair.

The present inventors are aware of a few devices that have been developed in the past for increasing the utility of a wheelchair. One such device is found in Japanese Patent No. 6-154,269, published on Jun. 3, 1994. This reference describes (according to the drawings and English abstract) a wheelchair that is convertible to a gurney or stretcher by means of a lever and mechanism, which may be manipulated by a person using the chair. No retractable table or desk surface, underseat storage, or variable handle configurations are disclosed.

Japanese Patent No. 6-169,968, published on Jun. 21, 1994, describes (according to the drawings and English abstract) a wheelchair that is especially configured to facilitate bathing by the occupant. A narrow open tray or shelf and a closable storage compartment are positioned along the opposite arms of the chair for access by the occupant of the chair. No retractable table or desk surface, underseat storage, or variable handle configurations are disclosed.

A web page published on the World Wide Web by MedicalProductsDirect.com, at least as of Apr. 4, 2005, describes a tilt and recline wheelchair by Invacare Company. The chair includes a small table or tray for the occupant, but no means for folding or retracting the tray is apparent. No underseat storage or variable handle configurations are disclosed.

Finally, a web page published on the World Wide Web by westons.com, at least as of Apr. 4, 2005, describes a series of accessories for a wheelchair, including an armrest pocket, a folding half lap tray, a tray that secures removably across the arms of the chair, a day pack, and a forwardly disposed underseat storage container. No retractable full width tray that remains attached to the wheelchair is provided, nor are any variable handle configurations disclosed.

None of the above patent publications and disclosures, taken either singly or in combination, is seen to describe the instant invention as claimed. Thus, wheelchair attachments solving the aforementioned problems are desired.

SUMMARY OF THE INVENTION

The wheelchair attachments include a series of devices configured for removable attachment to a conventional or slightly modified wheelchair to facilitate use of the wheelchair by occupants and/or attendants. One embodiment of the present invention comprises a retractable tray which folds between the chair and one wheel of the chair, and which deploys on an articulated arm to extend across the front of the chair for an occupant therein. Another embodiment comprises a series of interchangeable handles and grips, which may be installed upon the front or back of the chair for use by an attendant. The various handles and grips provide height adjustment for the attendant, as desired. A third embodiment comprises an underseat storage compartment, primarily accessible from the back of the chair by an attendant. Any of the above devices and accessories may be installed upon and/or used with a wheelchair in combination with or separately from one another as desired.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a series of attachments or accessories for installation upon and use with a wheelchair, either as separate, individual devices or in combination with one another. The various attachment embodiments of the present invention are adapted or configured for use with a conventional wheelchair C, generally as shown in FIGS. 1 through 7 of the drawings. Such wheelchairs C conventionally include a pair of armrests A1 and A2, which extend from a laterally folding or collapsible seat and wheel support structure or frame F. The frame F includes a pair of seatback support uprights U1 and U2 extending upwardly therefrom, with the corresponding armrests A1 and A2 extending forwardly from the uprights U1 and U2. A folding seat S and seatback B extend respectively across the frame F and uprights U1 and U2, with a pair of main support wheels W1 and W2 being positioned immediately outboard the frame F and arms A1 and A2. The above-described structure is conventional, with the attachments of the present invention being removably secured to the wheelchair C.

Figure 2:
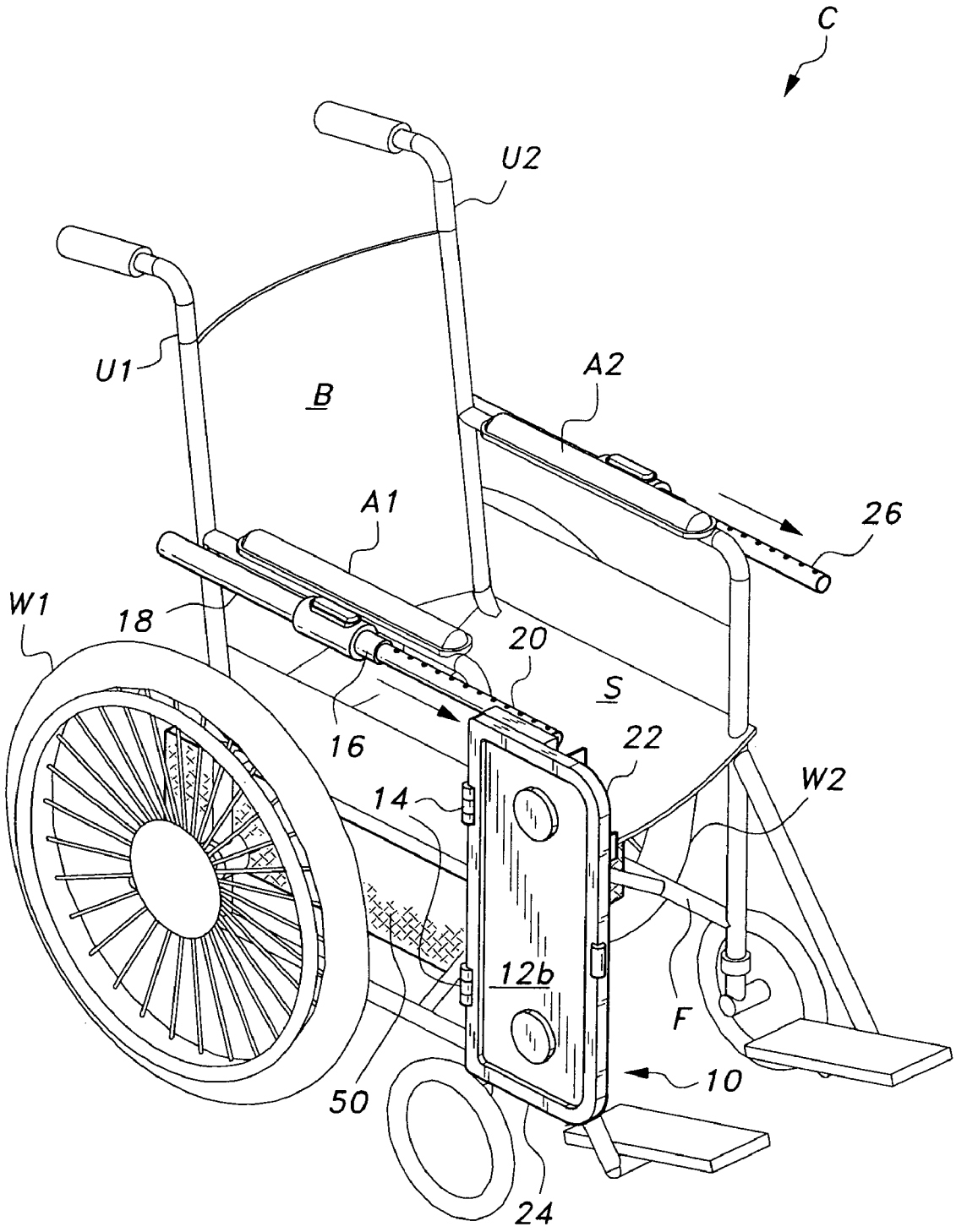
FIG. 2 is a perspective view of the wheelchair and retractable tray of FIG. 1, showing initial stages of deploying the tray.
Figure 3:
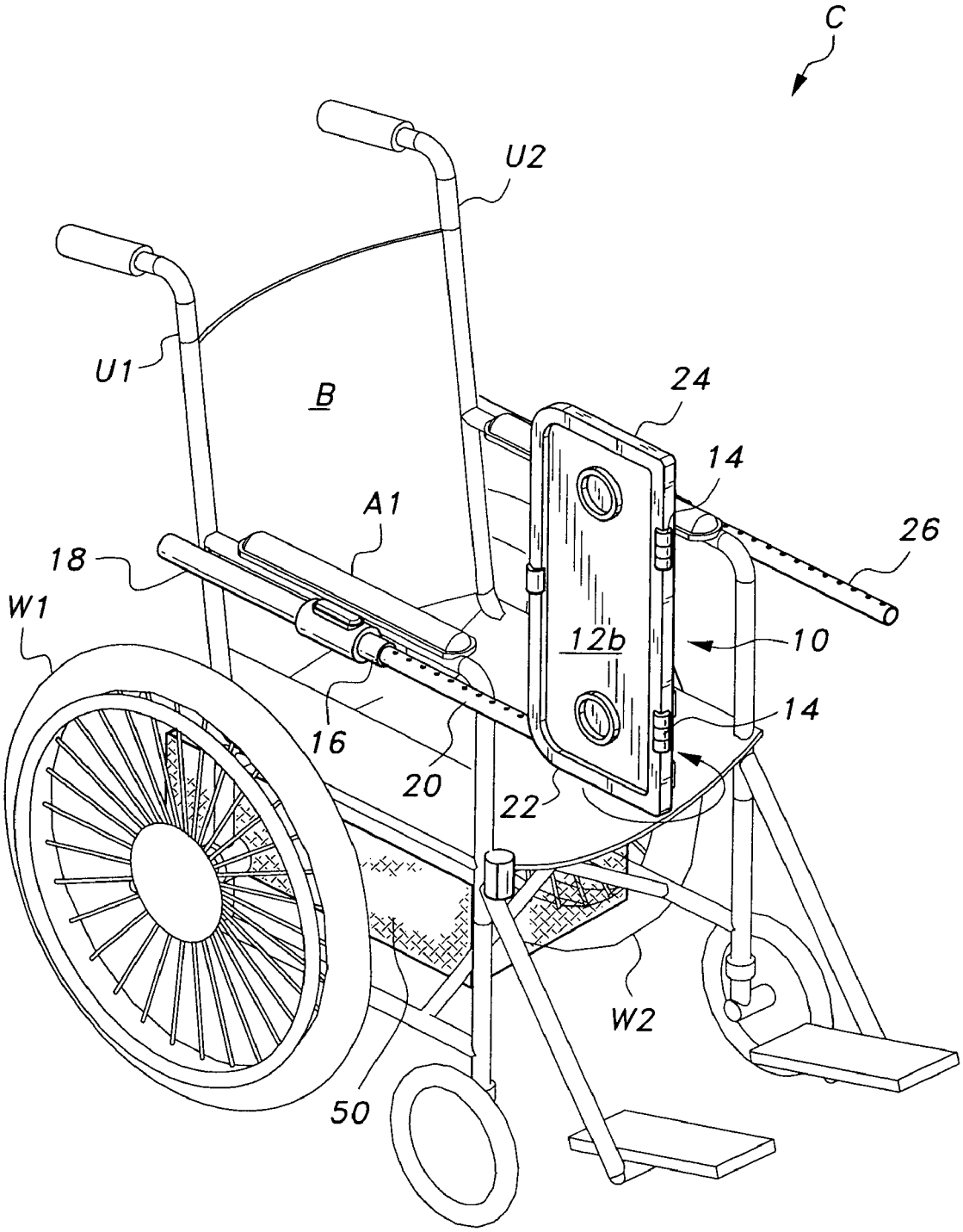
FIG. 3 is a perspective view of the wheelchair and retractable tray of FIGS. 1 and 2, showing the tray in an intermediate stage of deployment.
Figure 4:
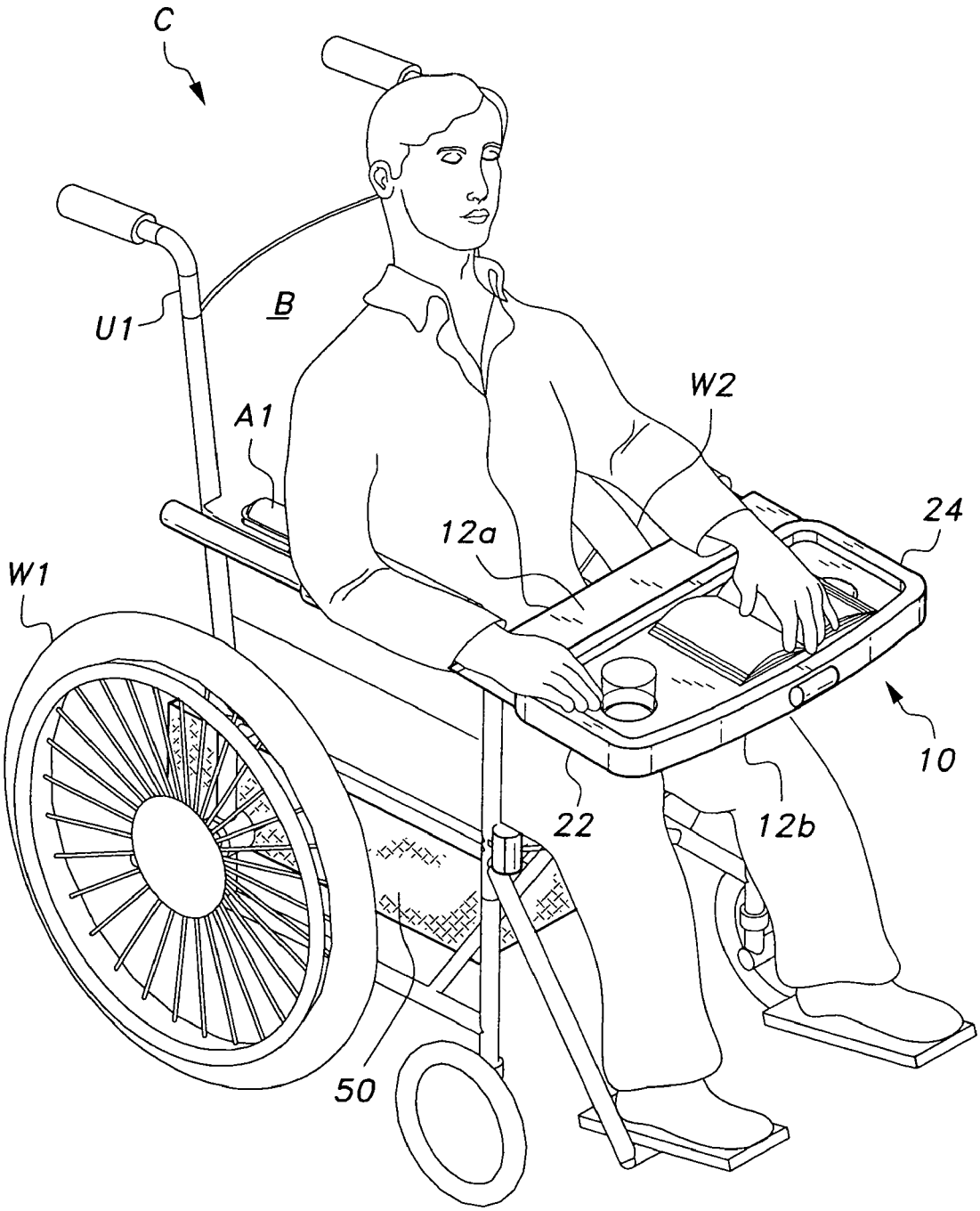
FIG. 4 is an environmental perspective view of the wheelchair and retractable tray of FIGS. 1 through 3, showing the tray completely deployed.

FIGS. 1 through 4 illustrate a first embodiment of the present attachments, comprising an articulating tray 10 which folds pivotally between one of the armrests of the chair C and the adjacent wheel, e.g., between the right hand armrest A1 and right wheel W1. It will be understood that the installation may be a mirror image of that shown, with the tray 10 extending from the left armrest A2 of the chair, if so desired. The tray 10 comprises two portions, respectively 12*a* and 12*b*, joined by hinges 14 defining a lateral hinge line when the tray 10 is deployed to the front of the wheelchair C. This allows the tray 10 to have a relatively narrow span from front to rear when folded, yet provides good fore and aft depth for the tray assembly 10 when fully deployed across the front of the chair C, as shown in FIG. 4 of the drawings.

Figure 1:
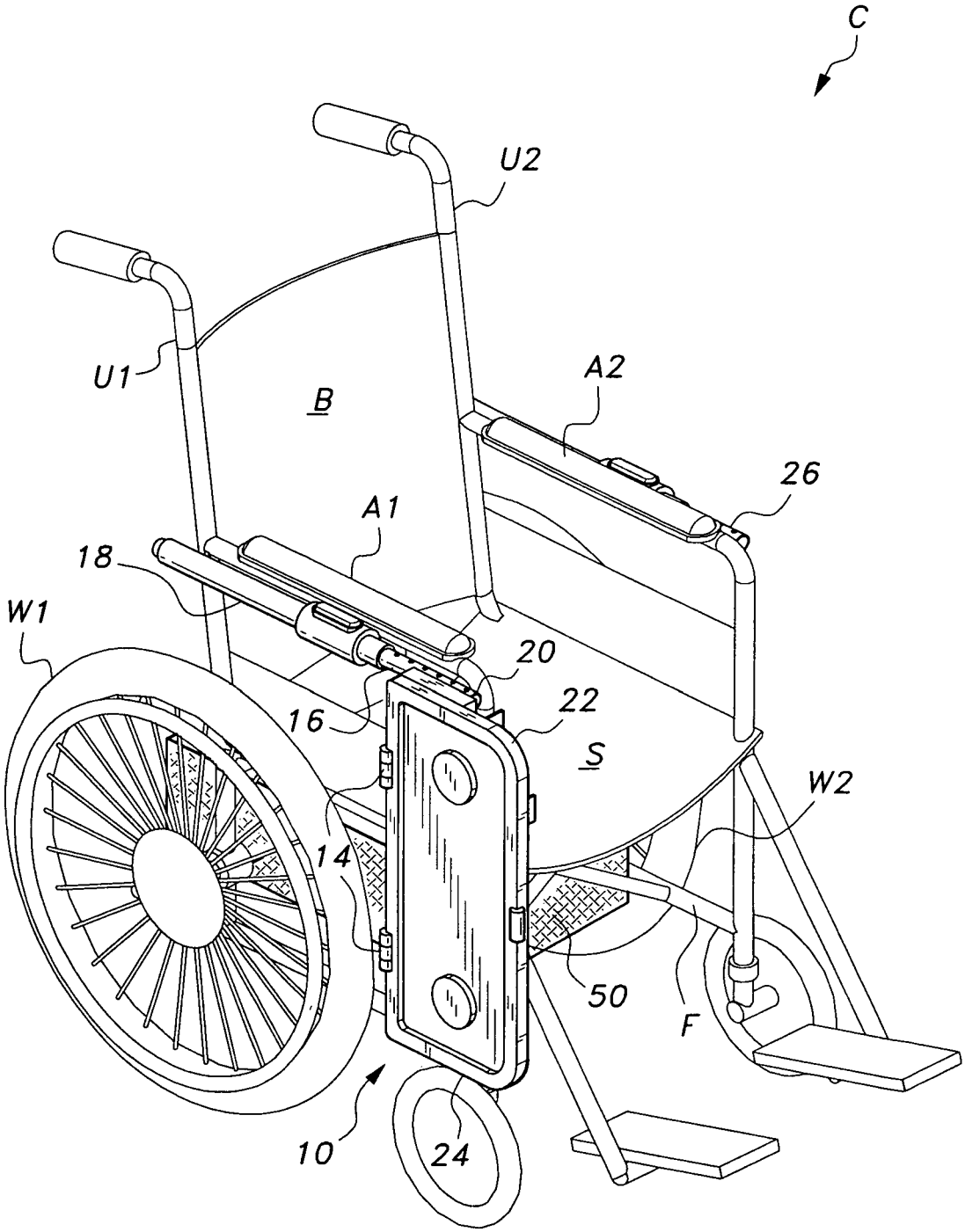
FIG. 1 is a perspective view of a wheelchair including the retractable tray attachment of the present invention, showing the tray in a retracted and stored configuration.

In FIG. 1, the tray 10 is shown completely retracted and folded immediately outwardly of the right side of the wheelchair frame F, generally forwardly of the right wheel W1 but in the plane of the space between the wheel W1 and the right side of the frame F. Subsequent FIGS. 2 through 4 show the deployment of the tray 10 to its completely deployed and extended position across the front of the two armrests A1 and A2.

In FIG. 2, the tray 10 is shown extended forwardly by means of its pivotal attachment to a telescoping arm assembly 16, which is attached to one of the armrests (e.g., the right hand armrest A2) by clamps or other attachment means, and which extends forwardly therefrom and parallel thereto. The telescoping arm assembly 16 includes a relatively fixed (i.e., it does not move relative to the armrest) armrest attachment portion 18, and a distal tray attachment support tube 20, which extends telescopically from the relatively fixed portion 18. (The telescoping arm assembly 16 may comprise more than two sections, as required.) The telescoping arm assembly 16 may have the configuration of a drawer slide or guide, or other telescopically extending configuration, if desired. The tray assembly 10 includes a tray attachment arm attachment end 22 and an opposite distal end 24. The tray 10 may have a cantilevered configuration when completely deployed, or the distal end 24 may be supported by a telescoping tray support tube 26 extending from the chair armrest opposite the tray support tube 20, e.g., the support tube 20 may extend from the first armrest A1 and the support tube 26 from the opposite second armrest A2.

In FIG. 2, the telescoping support tube 20 has been extended but the tray 10 remains in the same orientation as in its stored position, i.e., with its distal end or edge 24 extending downward below the opposite tray attachment arm attachment end 22 and support tube 20. However, in FIG. 3, the tray 10 has been swiveled through about 180° in a generally vertical plane about its swivel or pivot connection to the support tube 20 to arrive at the intermediate deployment configuration shown with the distal end 24 of the tray 10 positioned generally above the tray attachment arm end 22 thereof. The mechanism permitting this articulation is conventional, with such mechanisms being used in articulating desktops and writing surfaces often found in school auditorium seating and the like.

In FIG. 4, the tray 10 has been swung through an arc of about ninety degrees from the vertical to the horizontal to position the tray 10 in its fully deployed configuration and ready for use. The tray 10 may be cantilevered, depending upon the support structure provided by the swivel or pivot mechanism and the telescoping arm assembly 16. However, additional support may be desired for the distal end 24 of the tray. If such is the case, support tube 26 is provided to extend telescopically from the armrest opposite the support tube 20, as shown in FIGS. 2 and 3 and noted briefly further above. The tray 10 is stored by reversing the above-described procedure, to fold back into its stored configuration FIG. 5 of the drawings illustrates another embodiment of the present wheelchair attachments invention, comprising a series of interchangeably attachable handgrip attachments 28*a* through 28*c* for use by an attendant accompanying or propelling the wheelchair C. Each of the attachments 28*a* through 28*c* comprises a laterally symmetrical handgrip assembly, which spans the width of the chair C as a contiguous, unbroken structure when attached thereto, as can be seen in any of the four examples 28*a* through 28*c* in FIG. 5. All of the various handgrip attachments 28*a* through 28*c* install removably and interchangeably to the generally horizontal upper end extensions E1 and E2 of the conventional seatback uprights U1 and U2, or concentrically within the two parallel support tubes 20 and 26 extending from the front of the wheelchair C.

The extension sleeves E1 and E2, as well as the forward ends of the support tubes 20 and 26, are preferably provided with a series of lateral holes or passages H therethrough. The handgrip attachments 28*a* through 28*c* are each provided with opposed inserts 30*a* and 30*b* extending therefrom, which fit removably into the extension sleeves E1 and E2 or into the passages in the distal ends of the support tubes 20 and 26, as desired. Each of the inserts 30*a* and 30*b* includes a locking sleeve 32, with each sleeve 32 having a button therein that selectively disengages an internal pin when depressed. The pin in turn engages a corresponding hole or passage H in the tubular member to which the selected handgrip attachment is secured when the lock sleeve button is in its relaxed configuration. Pushing the sleeve buttons disengages the pins from the selected holes H of the wheelchair C, allowing the handgrip attachment to be removed from the chair C. Multiple holes H, as shown in the handgrip extensions E1 and E2 and in the left hand telescoping tray support arm 26 in FIG. 5, allow the handgrip attachments 28*a* through 28*c* to be positionally adjusted as they are secured to the wheelchair C.

The first handgrip attachment 28*a* comprises a wide, generally U-shaped component having forward extensions 30*a* and 30*b*, which plug into the existing ends of the seatback uprights U1 and U2. The lateral handlebar portion may include relatively soft and resilient covers 34 thereover, if so desired. The provision of a lateral handlebar allows an attendant pushing the chair C to have a much more ergonomically comfortable grip, rather than being required to twist the wrists to grip the conventional longitudinally extending handgrips G1 and G2.

Figure 5:
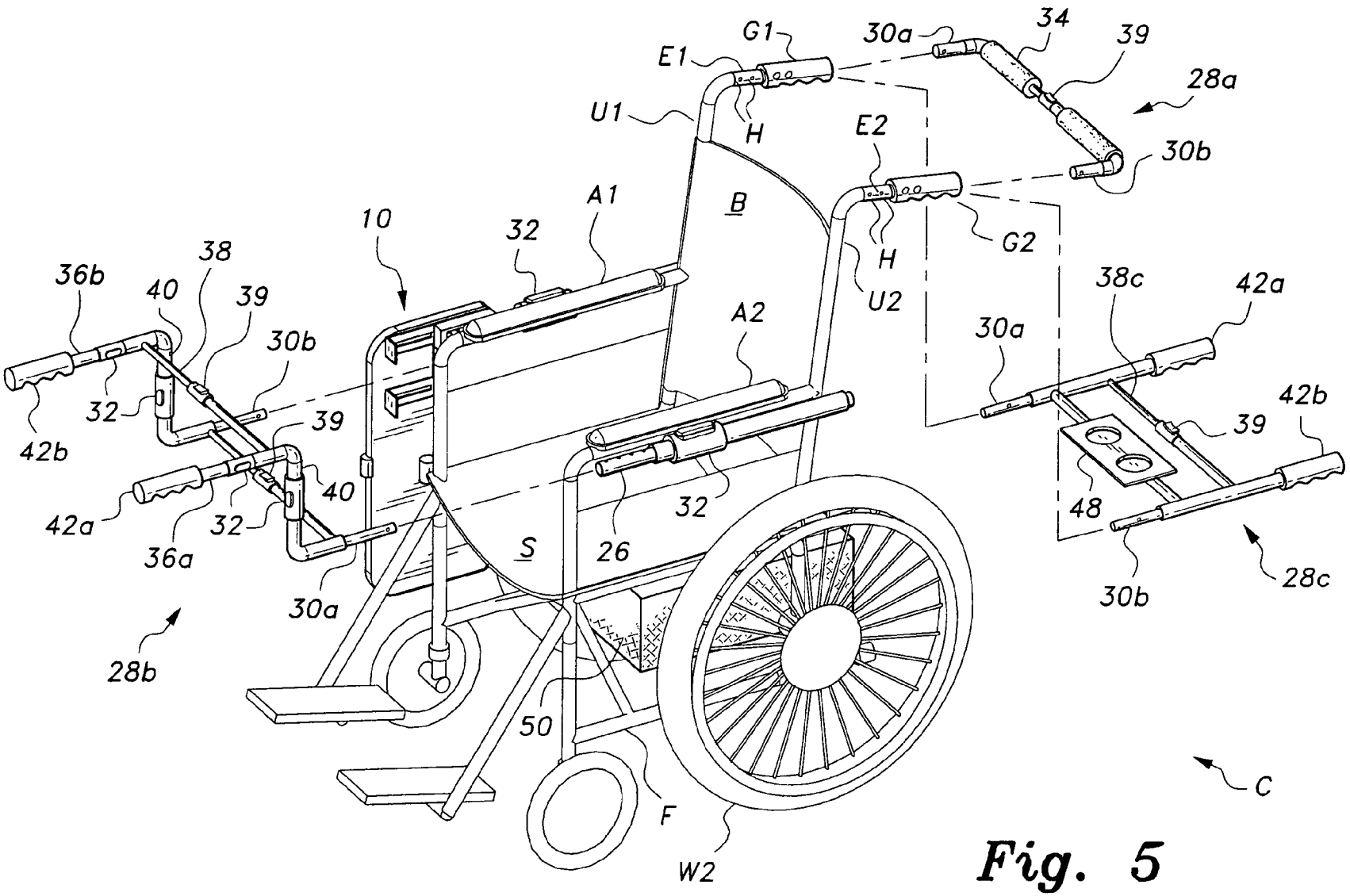
FIG. 5 is an exploded perspective view of a series of removably attachable handgrips for a wheelchair according to the present invention, showing their installation upon a wheelchair.

Another handgrip attachment 28*b*, shown at the front of the chair C in FIG. 5, comprises a pair of generally longitudinally extending lateral members 36*a* and 36*b*, with interconnecting crossmembers 38 joining the lateral members. The two lateral members 36*a* and 36*b* preferably each include an offset 40 therein, in order to allow the handgrips 42*a* and 42*b* to be positioned at a different height from the support tubes 20 and 26 at the front of the chair C or from the handgrip extensions E1 and E2 at the back of the chair. It will be seen that the offsets 40 may be made to any practicable length and/or may include adjustable locking sleeves 32 therein in the manner described above for the positional adjustability of the various handgrip attachments to the chair C. Moreover, the two handgrips 42*a* and 42*b* may be replaced by the single lateral handlebar of the first described handgrip extension 28*a*, if so desired. The height adjustment made possible by the adjustable offsets 40 enable an attendant to stand comfortably upright while manipulating the chair C from the front.

Finally, a third handgrip extension assembly 28*c* is shown at the back of the chair C, beneath the first extension 28*a* in FIG. 5. As in the other handgrip extensions 28*b* and 28*c*, the two separate handgrips 42*a* and 42*b* may be interchanged with a single lateral handlebar, if so desired. The handgrip extension assembly 28*c* may include a laterally disposed tray 48, e.g., a two-place cup holder. It will be understood that the tray 48 may be modified to have any practicable size and/or configuration.

Any of the various handgrip extensions 28*a* through 28*c* may be interchanged with one another at the front or back of the wheelchair C. It will be noted that the lateral span between the two forward tray support tubes 20 and 26 is slightly wider than the lateral span between the two handgrips G1 and G2. This is accommodated by providing a telescoping mechanism in each of the crossmembers extending between the respective lateral members of each of the handgrip attachments 28*a* through 28*c*. Each of the crossmembers, e.g., crossmembers 38 of the second extension 28*b* and crossmember 38*c* of extension 28*c*, comprises a pair of concentric telescoping tubes with a cam lever-type locking mechanism 39 disposed thereon. Opening the lever frees the two tubes to slide relative to one another, while closing the lever compresses the outer tube against the inner tube to lock the length of the assembly. This provides infinitesimal adjustment for the width of the handgrip attachments 28*a* through 28*c*, allowing them to be transferred between the front and the back of the wheelchair C, or to be adapted for use on other devices. The crossmember supporting the tray 48 of the third extension assembly 28*c* may also comprise two telescoping members, but need not include a locking mechanism as such a mechanism 39 is provided for the other crossmember 38*c*.

Figure 6:
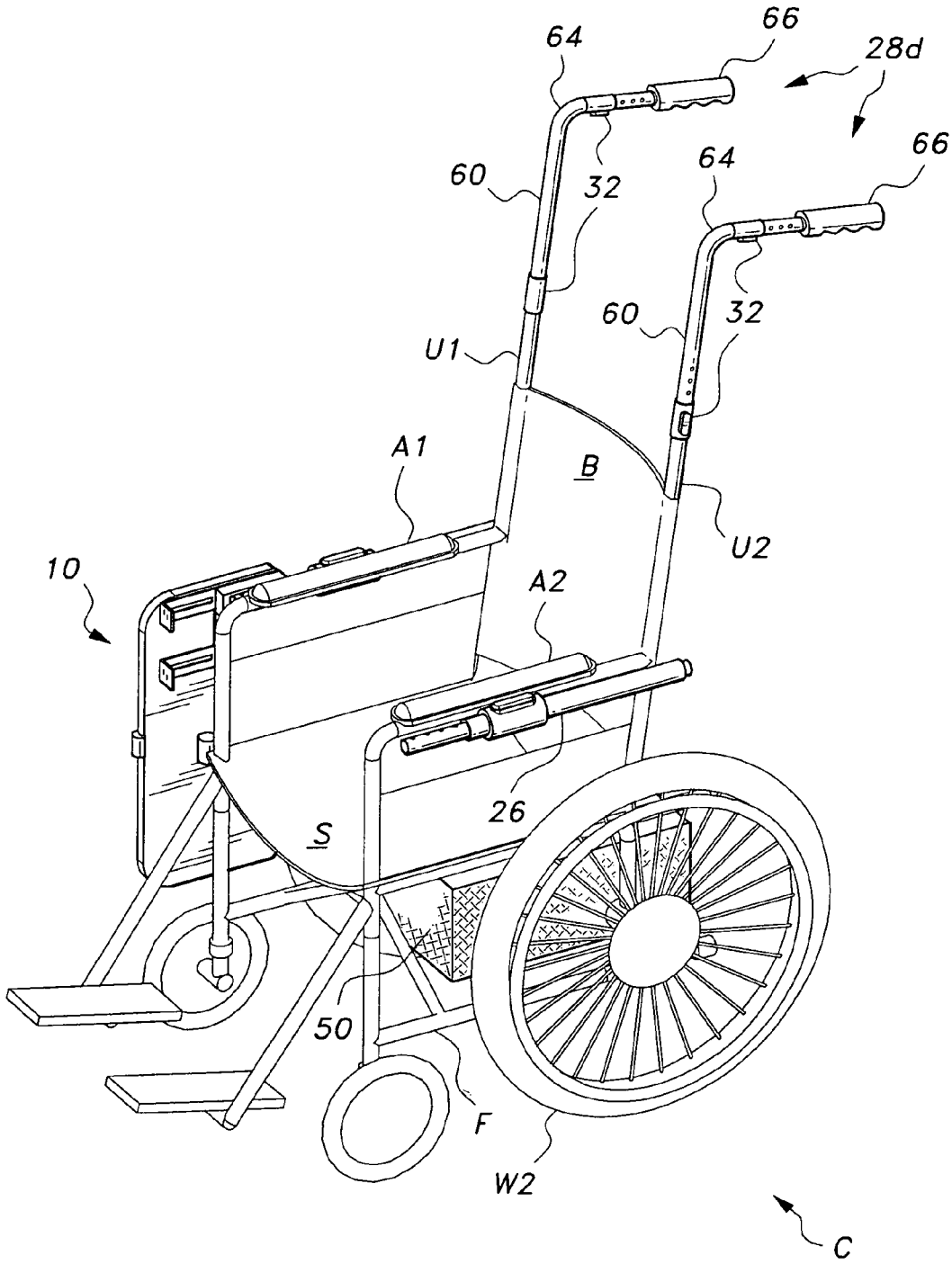
FIG. 6 is a perspective view of a wheelchair as seen from the left front with an alternative embodiment rear handle assembly according to the present invention.

FIG. 6 provides an illustration of additional handgrip attachments 28*d* for the wheelchair C. The attachments 28*d* comprise upright members 60, which telescope concentrically into the seatback support uprights U1 and U2 of the chair C. The upper ends of the two seatback support uprights U1 and U2 each include a locking sleeve 32 thereon, as in the lock sleeves 32 installed on the various extensions 28*a* through 28*c* illustrated in FIG. 5. An extension handle portion 64 having a rearwardly disposed bend extends from the upper end of each of the upright members 60 for attachment of the handgrips 66 and/or additional horizontally telescoping extensions. Much the same mechanism as used for the vertically telescoping extensions 60 provides for rearward extension of the handgrips 66 at the distal ends of the extension handles 64. Thus, the attachments 28*d* allow a person operating the chair C from behind to adjust both the height and rearward extension of the extension handgrips 66. The other handgrip extensions 28*a* though 28*c* of FIG. 5 may also be removably secured to the attachments 28*d*, if so desired.

Figure 7:
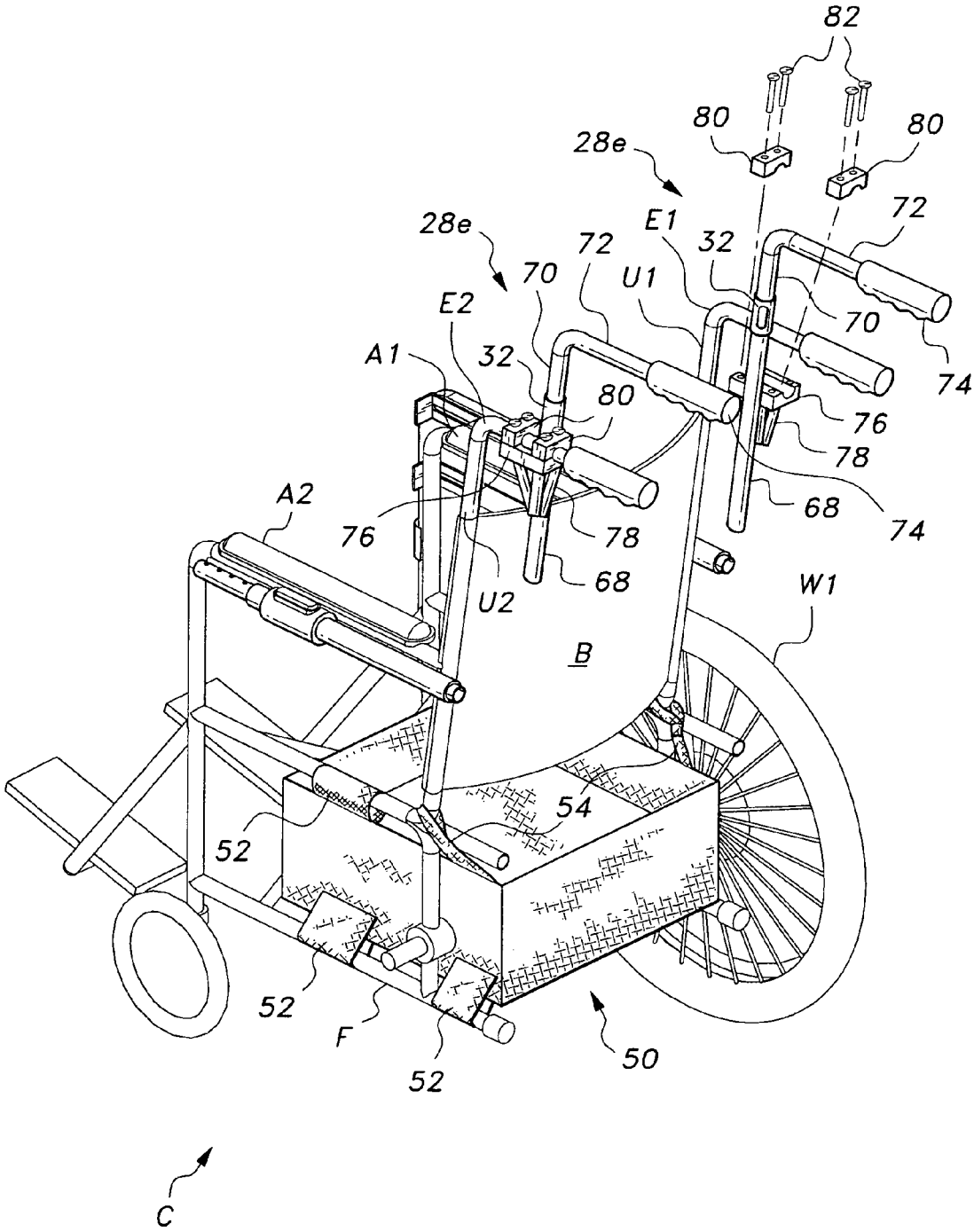
FIG. 7 is a left side and rear perspective view of a wheelchair with the left wheel and seat removed to show clearly the installation of an underseat storage compartment in the chair structure according to the present invention, as well as yet another adjustable handle embodiment.

FIG. 7 illustrates yet another removable and adjustable handle configuration, comprising handle assemblies 28*e*. The two handle assemblies 28*e* are identical to one another, although they appear to be mirror images of one another. This is due to the vertically adjustable handle extension provided with each assembly 28*e*, as the bodies of the assemblies 28*e* may be rotated about their respective handle extensions to secure to either the left or right wheelchair rear handle extension E2 or E1, as desired. Each handle assembly 28*e* includes a tubular sleeve 68, through which a handle extension 70 is concentrically installed.

The positions of the handle extensions 70 may be locked relative to their respective sleeves 68 by means of a lock sleeve 32, as provided for adjustment of other components of the wheelchair C and discussed further above. The handle extensions 70 each include a generally right angle bend with a distal end portion 72 having a supplemental handgrip 74 thereon. Each of the sleeves 68 is affixed to a lower clamp half 76 having a semicircular channel therein, for fitting about the underside of the conventional rearwardly extending handle extension E1 or E2 of the wheelchair C. A series of reinforcing braces 78 may be provided between the lower clamp halves 76 and their respective sleeves 68. Each of the assemblies 28*e* further includes a pair of removable upper clamps 80, which secure removably to the lower clamp halves by means of a series of thumb screws 82 or the like. The above described apparatus allows a person to install vertically adjustable handgrips to a conventional, unmodified wheelchair.

FIG. 7 also provides a detailed illustration of an underseat storage compartment 50, which may be removably installed to the seat S and wheel support frame structure F beneath the seat S of the wheelchair C. Portions of this storage compartment 50 are also shown in FIGS. 1 through 5 of the drawings. The storage compartment 50 is removably attached to the lateral structure of the wheelchair C by means of a series of lateral straps or flaps 52 using conventional connection means (e.g., Velcro®, snaps, ties, buttons, etc., as desired). The compartment 50 is located behind the conventional diagonal crossmembers of the wheelchair C when installed, thereby providing accessible storage space for an attendant accompanying the chair C and its occupant (if any) from behind the chair C.

The back of the storage device 50 includes opposed loops 54 or the like extending from the upper edges thereof, with the two loops 54 passing around the rearwardly disposed distal bases of the seat support members on each side of the chair C to support the rear of the storage container 50, generally as shown in FIG. 7. The underseat storage container 50 is preferably formed of a folding, flexible sheet material, e.g., an open mesh or more closely woven fabric material, flexible plastic sheet material, etc. However, rigid panels may be used in the bottom and/or walls of the device, so long as they are flexibly joined together to allow the container 50 to fold flat laterally when the wheelchair C is folded.

In conclusion, the wheelchair attachments in their various embodiments greatly improve the utility and convenience of a conventional wheelchair when installed thereon. Not only do the attachments make life easier for a person confined to a wheelchair, but they also ease the task of an attendant accompanying the chair. Accordingly, the wheelchair attachments will prove to be extremely popular additions to virtually any wheelchair, and may be adapted for use on other devices as well.

It is to be understood that the present invention is not limited to the embodiments described above, but encompasses any and all embodiments within the scope of the following claims.

We claim:

1. Wheelchair attachments for a wheelchair having at least a wheelchair frame, a pair of armrests attached to the frame, a wheel disposed outboard of each of the armrests, a pair of seatback support uprights, a seat, and a seat and wheel support frame, the attachments comprising:

a pair of support arms, each of the support arms including a proximal end adapted for attachment to a respective arm rest and a distal end;

a telescoping tray extension arm adapted for attachment to the distal end of one of the support arms;

an articulating tray attached to the tray extension arm, wherein the articulating tray comprises a first portion and a second portion pivotally attached to the first portion along a lateral line when the articulating tray is deployed across the front of the wheelchair;

at least one handgrip attachment adapted for being interchangeably installed to the support arms and to the seatback support uprights, wherein the at least one handgrip attachment comprises a plurality of laterally symmetrical handgrip assemblies, each of the plurality of assemblies including attachment means adapted for being removably and selectively attached to the support arms and seatback support uprights, whereby an attendant can grasp the handgrip assemblies and manipulate the wheelchair; and an underseat storage compartment adapted for being secured to the seat and wheel support frame beneath the seat.

2. The wheelchair attachments according to claim 1, wherein at least one of said handgrip assemblies further includes means for positionally adjusting said at least one handgrip assembly on the wheelchair.

3. The wheelchair attachments according to claim 2, wherein said means for adjusting further includes means for adjusting the position of said at least one handgrip assembly both horizontally and vertically.

4. The wheelchair attachments according to claim 1, further comprising means for adjusting lateral spacing between at least two of said handgrip assemblies.

5. The wheelchair attachments according to claim 4, further comprising a second tray disposed between two of said handgrip assemblies.

6. The wheelchair attachments according to claim 1, wherein said underseat storage compartment is formed of a folding, flexible material.

* * * * *